United States Patent [19]

Gresens

[11] Patent Number: 4,854,862

[45] Date of Patent: Aug. 8, 1989

[54] APPARATUS FOR THE HEAT TREATMENT OF A LENGTH OF CONTINUOUSLY MOVING MATERIAL

[75] Inventor: Barry Gresens, Benningen, Fed. Rep. of Germany

[73] Assignee: Bruckner Trockentechnik GmbH & Co. KG, Fed. Rep. of Germany

[21] Appl. No.: 226,409

[22] Filed: Jul. 28, 1988

[30] Foreign Application Priority Data

Aug. 16, 1987 [DE] Fed. Rep. of Germany ... 8711119[U]

[51] Int. Cl.[4] ..... F27B 9/28

[52] U.S. Cl. ..... 432/59; 432/72; 432/176; 432/152

[58] Field of Search ..... 432/59.8, 72, 176, 152

[56] References Cited

U.S. PATENT DOCUMENTS

| | | | |
|---|---|---|---|
| 4,116,620 | 9/1978 | Stibble | 432/59 |
| 4,384,850 | 5/1983 | Dixon | 432/176 |
| 4,493,640 | 1/1985 | Hanson | 432/72 |
| 4,548,579 | 10/1985 | Cunningham | 432/72 |

*Primary Examiner*—Henry C. Yuen

*Attorney, Agent, or Firm*—Sheldon & Mak

[57] ABSTRACT

Apparatus for the heat treatment of a length of continuously moving material in a plurality of treatment zones contains a fan to provide a stream of circulating air. The outer wall of the machine and fan housing is provided with an opening which can be closed by a closure device, through which the interior of the fan housing and the nozzle casing are accessible.

5 Claims, 1 Drawing Sheet

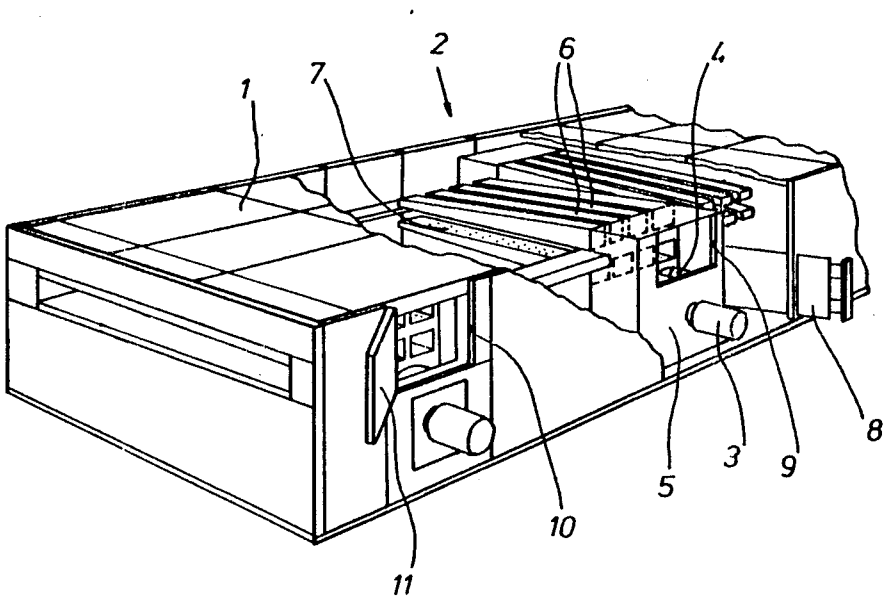
1
2
3
4
5
6
7
8
9
10
11

APPARATUS FOR THE HEAT TREATMENT OF A LENGTH OF CONTINUOUSLY MOVING MATERIAL

The invention relates to apparatus (according to the preamble to claim 1) for the heat treatment of a continuously moving length of material.

Apparatus of this type is used in particular for the drying and fixing of lengths of textile material.

The air which is circulated in the individual treatment zones by the fan necessarily takes up a certain proportion of fibres and foreign bodies which are deposited at certain points in the flow path, particularly in the region of the nozzles and in the fan housing, and therefore regular cleaning of the nozzles, the fan and the fan housing is necessary.

For this purpose it was necessary in the previously known constructions to enter the interior of the machien hosuing through door provided in the machine housing. For cleaning purposes the nozzles generally have to be removed and cleaned outside the machine housing. In the known constructions, access to the interior of the fan housing and cleaning thereof has proved equally awkward and time-consuming.

The object of the invention, therefore, is to construct apparatus of the type set out in the preamble to claim 1 which avoids these shortcomings in such a way that the nozzle casings, the fan and the interior of the fan housing can be cleaned in a particularly simple and timesaving manner.

This object is achieved according to the invention by the characterising features of claim 1.

Adavantageous embodiments of the invention are the subject matter of the subordinate claims.

One embodiment of the invention is shown in the drawing.

The tensioning machine for the heat treatment of a length of continuously moving material which is shown in a cut-away perspective view (partially borken off) in the drawing contains in a machine housing 1 a plurality of treatment zones which follow one another in the direction of movement of the length of material and of which the treatment zone 2 will be explained in greater detail below.

It contains a fan 4 which is arranged in the lower region of a square fan housing 6 and is driven by a motor 3. The interior of the fan housing 5 is connected to the delivery side of the fan.

The fan housing 5 is arranged on the inner face of a long wall of the machine housing 1, and the fan housings of succeeding treatment zones are each provided on different long sides of the machine housing 1.

Upper nozzle casings 6 and lower nozzle casings 7 are connected to the upper region of the fan housing 5. The air circulated by the fan is delivered from above and below by means of these nozzle casing to the length of material which is guided between the upper and lower nozzle casing 6, 7.

To return the air leaving the length of material, a return air channel (which is not visible in the drawing) is arranged in the upper region of the machine housing 1, leads to the intake side of the fan 4 and has filter and heating arrangements provided in it in the usual way. In this return air channel the air enters through a screen 8 which can be pulled out through a slot in the side wall of the machine housing 1 for cleaning purposes.

The outer long wall of the fan housing 5 facing the adjacent long wall of the machine housing 1 is provided in its upper region with a first opening 9 which can be closed by a closure device (not shown) and through which the interior of the fan housing 5 and the nozzle casings 6 and 7 are accessible from the exterior for cleaning purposes.

For this purpose the machine housing 1 is provided in the region of the first opening 9 in the fan housing 5 with a second opening 10 which can be closed by a hinged door 11 and through which the closure device for the first opening 9 in the fan housing is accessible.

As can be seen from the drawing, the first opening 9 provided in the fan housing 5 reaches as far as the upper edge of the housing 5 and thus extends over the entire range of heights of the inlet apertures of the nozzle casings 6 and 7. Therefore the interior of the upper and lower nozzle casings 6, 7 (including the nozzles provided on the outlet side of these casings) can be easily cleaned by means of a cleaning device (for example a dust extractor with a long suction pipe) which is introduced through the first opening 9 in the fan housing 5. Equally the interior of the fan housing as well as th fan 4 are readily accessible through the first opening 9 in the fan housing 5 for cleaning purposes.

For the sake of understanding it should be noted that in the drawing the solid thickness of the fan housing 5 has been omitted in order to make the inlet apertures of the upper nozzle casings 6 visible.

The closure device for the first opening 9 in the fan housing 5 can be formed for example by a lid which is fastened by means of releasable retaining elements, for example by tightening screws.

Suitable safety measures are advantageously taken in order to ensure that the lid closing the first opening 9 in the fan housing 5 (after opening of the doors 11) can only be removed when the motor 3 is switched off and the fan 4 has come to a standstill.

I claim:

1. Apparatus for the heat treatment of a length of material which is continuously moving through a plurality of succeeding treatment zones within a machine housing comprising:

(a) a fan housing in each of the treatment zones providing a stream of circulating air within each treatment zone;

(b) a fan housing located adjacent the inside of a long wall of the machine in each of the treatment zones, accommodating the fan in a lower region of the fan housing;

(c) a plurality of nozzle casings connected to an upper region of the fan housing within each of the treatment zones for delivering the stream of circulating air from the fan to the length of material;

(d) an upper region of an outer long wall of the fan housing facing an adjacent long wall of the machine housing being provided with a first opening closable by a closure device and through which the interior of the fan housing and the nozzle casings are accessible;

(e) the machine housing being provided in the region of the first opening in the fan housing with a closable second opening through which the closure device for the first opening in the fan housing is accessible.

2. Apparatus as claimed in claim 1, characterized in that the closure device for the first opening in the fan housing is formed by a lid which is fastened by means of releasable retaining elements, preferably tightening screws.

3. Apparatus as claimed in claim 1, characterized in that the second opening provided in the machine housing can be closed by a hinged door.

4. Apparatus as claimed in claim 1, characterized in that the fan housing is of square construction.

5. Apparatus as claimed in claim 4, characterized in that the first opening provided in the fan housing extends at least over the range of heights of the inlet openings of the nozzle casings.

* * * * *